US008164549B2

(12) United States Patent
Miyazawa

(10) Patent No.: US 8,164,549 B2
(45) Date of Patent: Apr. 24, 2012

(54) ELECTRONIC CIRCUIT FOR DRIVING A DRIVEN ELEMENT OF AN IMAGING APPARATUS, ELECTRONIC DEVICE, METHOD OF DRIVING ELECTRONIC DEVICE, ELECTRO-OPTICAL DEVICE AND ELECTRONIC APPARATUS

(75) Inventor: Takashi Miyazawa, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 810 days.

(21) Appl. No.: 11/865,921

(22) Filed: Oct. 2, 2007

(65) Prior Publication Data

US 2008/0111191 A1 May 15, 2008

(30) Foreign Application Priority Data

Nov. 14, 2006 (JP) ..... 2006-307550

(51) Int. Cl.
*G09G 3/30* (2006.01)
*G09G 3/32* (2006.01)

(52) U.S. Cl. ..... 345/78; 345/82

(58) Field of Classification Search ..... 345/36, 345/39, 44–46, 76–83, 208–215; 315/169.3; 313/463, 504

See application file for complete search history.

(56) References Cited

U.S. PATENT DOCUMENTS

| | | | | |
|---|---|---|---|---|
| 6,950,081 | B2 * | 9/2005 | Akimoto et al. | 345/55 |
| 2004/0246212 | A1 * | 12/2004 | Kobayashi et al. | 345/82 |
| 2005/0083270 | A1 * | 4/2005 | Miyazawa | 345/76 |
| 2006/0208977 | A1 * | 9/2006 | Kimura | 345/76 |
| 2007/0046592 | A1 * | 3/2007 | Ono et al. | 345/77 |

FOREIGN PATENT DOCUMENTS

| | | |
|---|---|---|
| JP | A 2003-122301 | 4/2003 |
| JP | A-2006-309258 | 11/2006 |
| WO | WO/2005/114629 | * 12/2005 |

* cited by examiner

*Primary Examiner* — Alexander Eisen
*Assistant Examiner* — Keith Crawley
(74) *Attorney, Agent, or Firm* — Oliff & Berridge, PLC

(57) ABSTRACT

An electronic circuit drives a driven element. The electronic circuit includes a signal line, a unit circuit connected to the signal line, and a voltage supply line. The unit circuit includes a transistor, a switch, and a capacitive element. The transistor includes a gate terminal, a first terminal, a second terminal connected to the voltage supply line, and a channel between the first and second terminals. The switch controls electrical connection between the gate terminal and one of the first and second terminals. A conductive state between the first and second terminals is controlled by a gate voltage applied to the gate terminal. During a first period, the switch is changed from an off state to an on state. During a second period, the switch is changed to an off state.

15 Claims, 7 Drawing Sheets

< SETTING PERIOD PST - PERIOD P2 >

ELECTRONIC CIRCUIT FOR DRIVING A DRIVEN ELEMENT OF AN IMAGING APPARATUS, ELECTRONIC DEVICE, METHOD OF DRIVING ELECTRONIC DEVICE, ELECTRO-OPTICAL DEVICE AND ELECTRONIC APPARATUS

BACKGROUND

1. Technical Field

Several aspects of the present invention relates to a technology that controls various driven elements, such as an organic light emitting diode (hereinafter, referred to as "OLED") element, a liquid crystal element, an electrophoretic element, an electrochromic element, an electron emission element and a resistance element.

2. Related Art

Various technologies have been proposed for driving various driven elements. Japanese Unexamined Patent Application Publication No. 2003-122301 (specifically, FIG. 1), for example, describes a configuration in which a plurality of unit circuits, each of which includes an OLED element as a driven element, are arranged in a planar manner. Each of the unit circuits includes a driving transistor, a reset transistor and a light emission control transistor. The driving transistor controls an electric current supplied to the OLED element in accordance with its gate voltage. The reset transistor connects the driving transistor to a diode. The light emission control transistor switches the supply/interrupt of electric current to the OLED element. According to the configuration described in JP-A-2003-122301, it is possible to compensate for an error (variation) of a threshold voltage of the driving transistor in each of the unit circuits.

In the meantime, the total number of transistors that form a single unit circuit is desirably small. As the number of transistors increases, the configuration of the unit circuit becomes complex. Thus, manufacturing costs increase. In addition, in an electro-optical device that uses unit circuits as pixels, there is a problem that, as the total number of transistors increases, the aperture ratio decreases. However, it is difficult to reduce the total number of transistors in each of the unit circuits. For example, in the configuration described in JP-A-2003-122301, in order to turn off the OLED element during a period when data are written to the corresponding unit circuit, it is impossible to omit a light emission control transistor.

SUMMARY

An advantage of some aspects of the invention is that it is effective to, for example, simplify the configuration of each of the unit circuits.

A first aspect of the invention provides an electronic circuit that drives a driven element to which driving voltage or driving current is supplied. The electronic circuit includes a signal line, a unit circuit connected to the signal line, and a voltage supply line. The unit circuit includes a driving transistor, a switching element, and a capacitive element. The driving transistor includes a gate terminal, a first terminal, a second terminal connected to the voltage supply line, and a channel formed between the first terminal and the second terminal. The switching element controls electrical connection between the gate terminal of the driving transistor and one of the first terminal and the second terminal. The capacitive element includes a first electrode connected to the gate terminal of the driving transistor and a second electrode connected to the signal line. A conductive state between the first terminal and the second terminal is controlled by a gate voltage applied to the gate terminal. During a first period (for example, a first half period of a period P1 shown in FIG. 2), which is at least part of a period during which the switching element is in an off state, a voltage level of the gate voltage changes from a first voltage level to a second voltage level by a first signal (for example, a voltage V0 shown in FIG. 2 and FIG. 8) being supplied to the signal line. During a second period (for example, a first half period of a period P2 shown in FIG. 2), which is at least part of a period during which a second signal is supplied to the signal line, the switching element is set to an on state. During at least part of the second period, a voltage level of the gate voltage is set to a third voltage level. For example, the switching element may be made into an on state after a voltage level of the gate voltage is set to the second voltage level, so that the gate voltage may be changed to the third voltage level.

Note that the first signal may employ a signal that is, for example, separately generated from the second signal. In addition, the first signal may be set in accordance with the second signal that is supplied to the signal line before the supply of the first signal (which is, for example, the second signal supplied to a preceding unit circuit to which data are written) or in accordance with the second signal that is supplied after the first signal. Furthermore, in advance of writing of data, a precharge signal that charges or discharges the signal line may also be used as the first signal. Note that, in the configuration in which an error of the threshold voltage of the driving transistor is compensated by initializing the gate terminal of the driving transistor to a voltage corresponding to the threshold voltage, a signal, which reliably makes the driving transistor enter an on state in advance of the initialization, may be supplied as the first signal.

In the first aspect of the invention, a conductive state between the first terminal and the second terminal, when the gate voltage is set to the second voltage level, may be higher (that is, closer to an on state) than a conductive state between the first terminal and the second terminal, when the gate voltage is set to the first voltage level. According to the above aspect, because the conductive state between the first terminal and the second terminal is set higher before the gate voltage is set to the third voltage level, the operation is stably performed by suppressing an influence of variation in the gate voltage of the driving transistor due to a disturbance, such as noise.

Furthermore, in a specific aspect of the invention, a difference, during the second period, between a voltage level of the second electrode and the third voltage level may correspond to an integral quantity of driving current supplied to the driven element during a predetermined period. Note that the predetermined period may be set arbitrarily; however, the predetermined period may be, for example, (1) one horizontal scanning period, (2) a period from the time when a data signal is supplied to the unit circuit to the time when the next data signal is supplied to the unit circuit, and (3) one frame period that completes displaying one gray scale level.

In the above aspect of the invention, the driven element may be driven to a state corresponding to a difference, during the second period, between a voltage level of the second electrode and the third voltage level. For example, the integral quantity of driving current supplied to the driven element during the predetermined period may be set in accordance with a difference, during the second period, between the voltage level of the second electrode and the third voltage level. In other words, the time length in which the driving current or the driving voltage is supplied to the driven element may be set in accordance with a difference, during the second period, between the voltage level of the second electrode and the third voltage level.

An aspect of the invention may be specified as an electronic device that includes the electronic circuit according to the above described aspects. A second aspect of the invention provides an electronic device. The electronic device includes a signal line, a plurality of unit circuits connected to the signal line, and a voltage supply line. One of the plurality of unit circuits includes a driving transistor, a driven element, a switching element, and a capacitive element. The driving transistor includes a gate terminal, a first terminal, a second terminal connected to the voltage supply line, and a channel formed between the first terminal and the second terminal. The switching element controls electrical connection between the gate terminal of the driving transistor and one of the first terminal and the second terminal. The capacitive element includes a first electrode connected to the gate terminal of the driving transistor and a second electrode connected to the signal line. A conductive state between the first terminal and the second terminal is controlled by a gate voltage applied to the gate terminal. During a first period, which is at least part of a period during which the switching element is in an off state, a voltage level of the gate voltage changes from a first voltage level to a second voltage level by a first signal being supplied to the signal line. During a second period, which is at least part of a period during which a second signal is supplied to the signal line, the switching element is set to an on state. During at least part of the second period, a voltage level of the gate voltage is set to a third voltage level. With the above configuration as well, the same operation and advantageous effects as those of the electronic circuit according to the specific aspects of the invention are obtained. Note that the first signal may be, for example, a data signal supplied to another unit circuit that is different from the above one of the plurality of unit circuits.

In the electronic device according to the above aspect, a voltage control circuit (for example, a voltage control circuit 27 shown in FIG. 1) that sets a potential of the voltage supply line to a plurality of potentials and/or a voltage control circuit (for example, a switch SW0 shown in FIG. 7) that controls electrical connection between the voltage supply line and a predetermined potential may be further provided.

The electronic device according to the above aspects may be used for various electronic apparatuses. A typical example of the electronic apparatus may be an apparatus that uses the electronic device as a display device. The electronic apparatus of this type includes a personal computer, a mobile telephone, and the like. However, applications of the electronic device according to the aspects of the invention are not limited to image display. For example, the electronic device according to the aspects of the invention may be applied to an exposure apparatus (exposure head) that forms a latent image on an image carrier, such as a photoreceptor drum, by irradiating rays of light.

A third aspect of the invention provides an electronic device. The electronic device includes a signal line, a unit circuit connected to the signal line, and a voltage supply line. The unit circuit includes a driving transistor, a driven element, a switching element, and a capacitive element. The driving transistor includes a gate terminal, a first terminal, and a second terminal connected to the voltage supply line. A conductive state between the first terminal and the second terminal is set in accordance with a voltage of the gate terminal. The switching element controls electrical connection between the gate terminal of the driving transistor and one of the first terminal and the second terminal. The capacitive element includes a first electrode connected to the gate terminal of the driving transistor and a second electrode connected to the signal line. By setting the voltage of the gate terminal in accordance with the supply of a data voltage to the signal line, at least one of a driving current and a driving voltage corresponding to the conductive state between the first terminal and the second terminal is supplied to the driven element. At least during a first period and a second period, the switching element is in an off state. During the first period, the signal line is supplied with a predetermined voltage (for example, a voltage V0 shown in FIG. 2 and FIG. 8). The driving transistor enters an on state owing to a change in voltage of the gate terminal in accordance with the supply of the predetermined voltage to the signal line. During a second period, the signal line is supplied with the data voltage.

In the electronic device according to the above aspects, a switching element may be arranged between the signal line and the second electrode to control electrical connection therebetween (to switch supply/interrupt voltage of the signal line to the second electrode); however, in light of a further simplification of the unit circuit, the second electrode may be directly connected to the signal line (that is, without intervening switching element).

In the above aspects of the invention, during a driving period that comes after a setting period that includes the first period and the second period has elapsed, the switching element may be made into an off state to set the first electrode to a floating state, while a control voltage that changes with time may be supplied to the second electrode. The voltage of the first electrode (that is, the voltage of the gate terminal of the driving transistor) varies in accordance with a differential value between the data voltage and the control voltage owing to a capacitive coupling that occurs in the capacitive element. Thus, according to the above aspect of the invention, it is possible to drive the driven element over the time length corresponding to the data voltage.

Note that, in a driving circuit of the above aspects, a circuit that supplies the data voltage to the unit circuit and a circuit that supplies the control voltage to the unit circuit may be mounted on an electronic device as separate circuits that are located a distance from each other, or may be mounted on an electronic device as a single circuit (for example, an IC chip) in which both of the above circuits are included. In addition, a wiring that supplies the control voltage to the unit circuit may use the signal line or may use a separate wiring, that is different from the signal line, through which the control voltage is supplied to the unit circuit.

Furthermore, in an specific example of the aspect, during at least part of the setting period, a voltage of the voltage supply line may be set to a first voltage value that is lower than that of the first terminal, and, during at least part of the driving period, a voltage of the voltage supply line may be set to a second voltage value that is higher than that of the first terminal. According to the above aspect, because the voltage of the voltage supply line is set to the first voltage value that is lower than that of the first terminal during at least part of the setting period, in comparison to a configuration in which the voltage of the voltage supply line is set to the second voltage value, electric energy applied to the driven element during the setting period (a driving current or a driving voltage supplied to the driven element) is reduced. Thus, even when the switching element (for example, a light emission control transistor described in JP-A-2003-122301) that controls the supply/interrupt of electric energy to the driven element is not arranged, it is possible to suppress (ideally, stop) the supply of electric energy to the driven element during the setting period in principle. Although it is not necessary to provide a light emission control transistor in principle, it is not intended to exclude the configuration in which the light emission control transistor is arranged from the scope of the invention. That is, even in the configuration of the aspects of the invention, a switching element that controls the supply/interrupt of electric energy to the driven element, like the light emission control transistor described in JP-A-2003-122301, in order to reliably specify a period during which the driven element is driven, may be arranged.

In the meantime, the transistors that form the unit circuit (particularly, the driving transistor) may include, for example, a transistor (typically, a thin-film transistor) that includes a semiconductor layer formed of a material selected from various semiconductor materials (for example, a polycrystal silicon, a microcrystal silicon, a monocrystal silicon or an amorphous silicon). It has been known that the transistor that has a semiconductor layer formed of an amorphous silicon, for example, has a threshold voltage that changes with time when a direction in which electric current flows is permanently fixed. According to the above aspect, electric current (for example, electric current I0 shown, in FIG. 5) flows from the first terminal through the second terminal to the voltage supply line during the setting period, while electric current flows from the second terminal through the first terminal to the driven element during the driving period. That is, the direction in which electric current flows through the driving transistor is inverted between during the setting period and during the driving period, so that, according to the above aspect, even when the semiconductor layer of the driving transistor is formed of an amorphous silicon, it is possible to suppress variation in the threshold voltage. In other words, it is particularly appropriate to apply the above aspect to a configuration in which the semiconductor layer of the driving transistor is formed of an amorphous silicon.

Furthermore, in the aspect of the invention, the switching element may be a switching transistor, and transistors included in each of the unit circuits may be the driving transistor and the switching transistor only. According to the above aspect, it is advantageous in that the transistors included in each of the unit circuits are reduced to two transistors, that is, the driving transistor and the switching transistor.

In the above described configuration, an error of the threshold voltage of the driving transistor and/or driven element is compensated in such a manner that the gate terminal is electrically connected to one of the first terminal and the second terminal through the switching element, while, on the other hand, the gate voltage of the driving transistor is set to a voltage value corresponding to a voltage of the signal line that is capacitively coupled to the gate through the capacitive element. Thus, with an extremely simple configuration, it is possible to drive the driven element while compensating for an error of the threshold voltage of the driving transistor and/or driven element. Furthermore, because the signal line is supplied with a predetermined voltage during the first period, the driving transistor is in an on state during the first period, irrespective of the gate voltage of the driving transistor before the commencement of the first period. Thus, the operation is stably performed by suppressing an influence of variation in the gate voltage of the driving transistor due to a disturbance, such as noise.

The driven elements of the aspects of the invention include all elements that are driven electrically. A typical example of the driven element is an electro-optical element that varies an optical characteristic (gray scale level), such as luminance or transmittance ratio, by the application of electric energy. A fourth aspect of the invention provides an electro-optical device. The electro-optical device includes a signal line, a plurality of unit circuits connected to the signal line, and a voltage supply line. One of the plurality of unit circuits includes a driving transistor, an electro-optical element, a switching element, and a capacitive element. The driving transistor includes a gate terminal, a first terminal, a second terminal connected to the voltage supply line, and a channel formed between the first terminal and the second terminal. The switching element controls electrical connection between the gate terminal of the driving transistor and one of the first terminal and the second terminal. The capacitive element includes a first electrode connected to the gate terminal of the driving transistor and a second electrode connected to the signal line. A conductive state between the first terminal and the second terminal is controlled by a gate voltage applied to the gate terminal. During a first period, which is at least part of a period during which the switching element is in an off state, a voltage level of the gate voltage changes from a first voltage level to a second voltage level by a first signal being supplied to the signal line. During a second period, which is at least part of a period during which a second signal is supplied to the signal line, the switching element is set to an on state. During at least part of the second period, a voltage level of the gate voltage is set to a third voltage level. According to the above electro-optical device as well, the same operation and advantageous effects as those of the electronic device according to the aspects of the invention are obtained. Moreover, the aspects described above regarding the electronic circuit and the electronic device may also be applied to the electro-optical device.

In addition, an aspect of the invention provides a method of driving the electronic device according to the above described aspects. A fifth aspect of the invention provides a method of driving an electronic device that includes a unit circuit connected to a signal line. The unit circuit includes a driving transistor, a driven element, a switching element, and a capacitive element. The driving transistor includes a gate terminal, a first terminal, a second terminal connected to a voltage supply line, and a channel formed between the first terminal and the second terminal. The switching element controls electrical connection between the gate terminal of the driving transistor and one of the first terminal and the second terminal. The capacitive element includes a first electrode connected to the gate terminal of the driving transistor and a second electrode connected to the signal line. A conductive state between the first terminal and the second terminal is controlled by a gate voltage applied to the gate terminal. The method includes changing a voltage level of the gate voltage from a first voltage level to a second voltage level by a first signal being supplied to the signal line during a first period, which is at least part of a period during which the switching element is in an off state, setting the switching element to an on state during a second period, which is at least part of a period during which a second signal is supplied to the signal line, and setting the voltage level of the gate voltage to a third voltage level during at least part of the second period. According to the above method as well, the same operation and advantageous effects as those of the electronic device according to the aspects of the invention are obtained. Moreover, the aspects described above regarding the electronic device may also be applied to this method of driving the electronic device.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
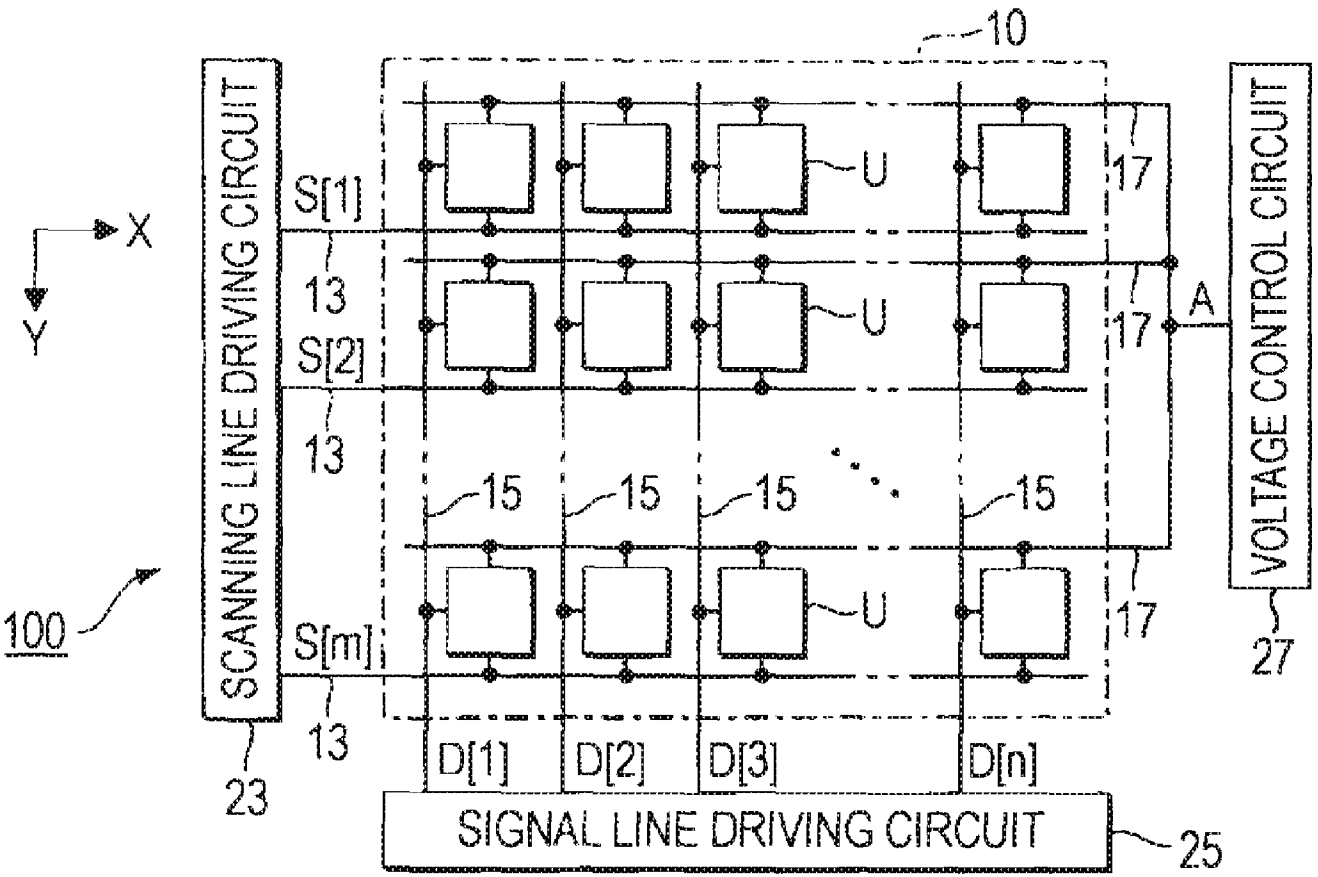
FIG. 1 is a block diagram that shows the configuration of an electronic device according to a first embodiment of the invention.

FIG. 1 is a block diagram that shows the configuration of an electronic device according to a first embodiment of the invention. The electronic device 100 shown in the drawing is an electro-optical device that may be employed in various electronic apparatuses as a device that displays an image. The electronic device 100 includes an element array portion 10, a scanning in driving circuit 23, a signal line driving circuit 25, and a voltage control circuit 27. A plurality of unit circuits U are arranged in the element array portion 10 in a planar manner. The scanning line driving circuit 23 and the signal line driving circuit 25 drive each of the unit circuits U. The voltage control circuit 27 supplies each of the unit circuits U with a voltage A. Note that the scanning line driving circuit 23, the signal line driving circuit 25 and the voltage control circuit 27 may be mounted on the electronic device 100 as separate circuits or a portion or all of these circuits may be mounted on the electronic device 100 as an integrated circuit.

As shown in FIG. 1, m scanning lines 13 that extend in an X direction and n signal lines 15 that extend in a Y direction perpendicular to the X direction are formed in the element array portion 10 (m and n are natural numbers). Each of the unit circuits U is arranged at a position corresponding to the intersection of the scanning line 13 and the signal line 15. Thus, these unit circuits U are arranged in a matrix of m rows and n columns.

In the element array portion 10, m voltage supply lines 17 are also formed so as to extend in the X direction in pairs with the scanning lines 13. Each of the voltage supply lines 17 is commonly connected to an output end of the voltage control circuit 27. Thus, a voltage A output from the voltage control circuit 27 is commonly supplied through the voltage supply lines 17 to the plurality of unit circuits U.

Figure 2:
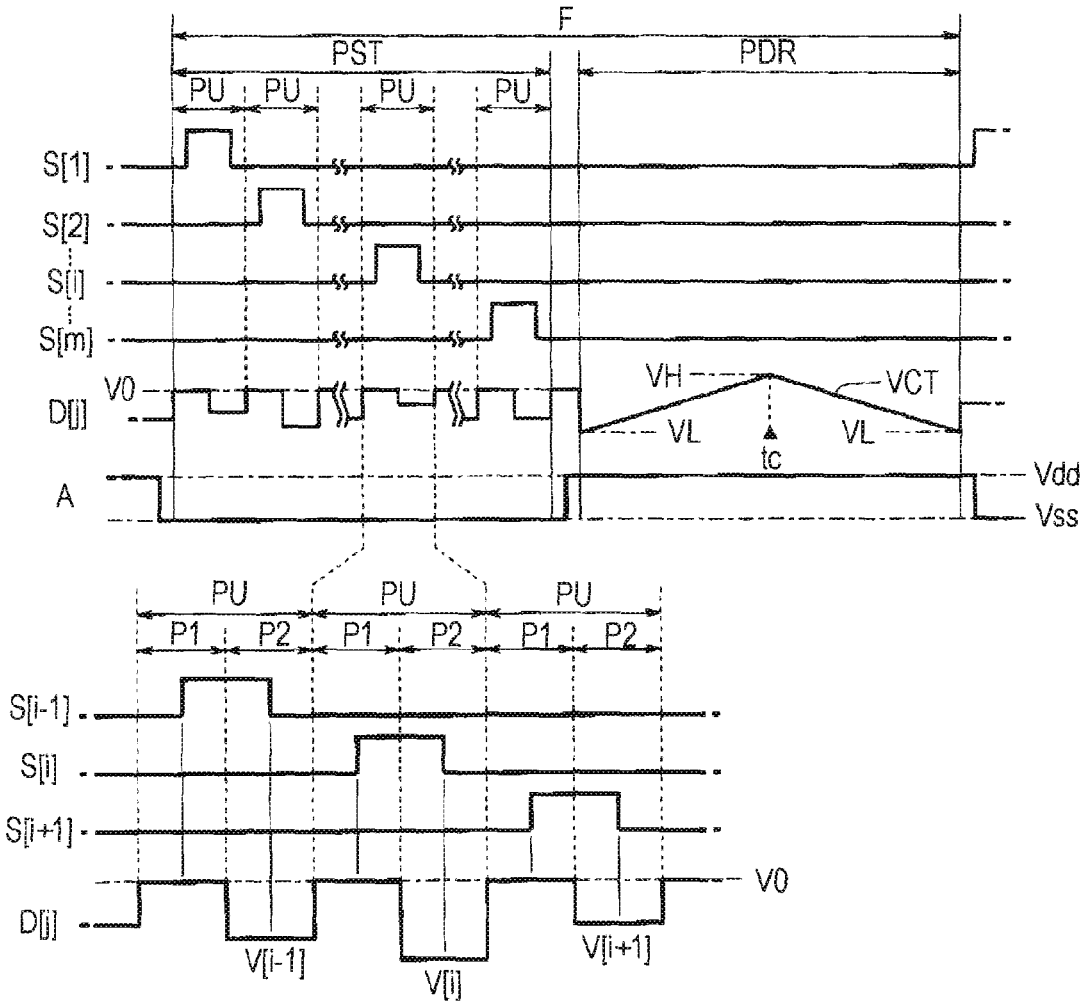
FIG. 2 is a timing chart for explaining the operation of the electronic device.

FIG. 2 is a timing chart for explaining the operation of the electronic device 100. As shown in the drawing, each frame F includes a setting period PST and a driving period PDR. One setting period PST includes m unit periods PU corresponding to the total number of rows of the unit circuits U (the total number of lines of the scanning lines 13). Furthermore, one unit period PU includes a first period P1 and a second period.

As shown in FIG. 2, the voltage control circuit 27 sets the voltage A, which is supplied to each of the voltage supply lines 17, to a voltage value Vss during the setting period PST or to a voltage value Vdd during the driving period PDR. The voltage value Vss is a potential (ground potential), which is a reference of voltages used in components. The voltage value Vdd is a voltage that is higher than the voltage value Vss (for example, a high-level side power supply potential).

The scanning line driving circuit 23 shown in FIG. 1 is a circuit that sequentially selects m scanning lines (selects the unit circuits U in units of row) during the setting period PST. More specifically, the scanning line driving circuit 23, as shown in FIG. 2, generates scanning signals S[1] to S[m] that sequentially attain a high level during the corresponding unit period PU within the setting period PST and then outputs the signals to the corresponding scanning lines 13. The scanning signal S[i] that is supplied to the i-th (i is an integer that satisfies $1 \leqq i \leqq m$) scanning line 13 is at a high level during a period from the time point when a predetermined time has elapsed since the starting point of the i-th unit period PU to the time point that comes a predetermined time earlier than the end point of the same unit period PU within the setting period PST, and maintains a low level during the other period (including the driving period PDR). When the scanning signal S[i] is changed to a high level, it means selection of the i-th row.

The signal line driving circuit 25 outputs data signals D[1] to D[n] to the signal lines 15. As shown in FIG. 2, the data signal D[j] supplied to the j-th (j is an integer that satisfies $1 \leqq j \leqq n$) signal line 15 is set to a predetermined voltage V0 (which will be specifically described later) during the first period P1 in each of the unit circuits PU within the setting period PST. Furthermore, the data signal D[j] attains a data voltage V[i] corresponding to a gray scale level specified by the i-th row and j-th column unit circuit U in the second period P2 during the i-th unit period PU (that is, the unit period PU when the i-th row is selected) within the setting period PST. The gray scale level of each unit circuit U is specified by an image signal that is specified externally.

On the other hand, all the data signals D[1] to D[n] during the driving period PDR are set to a control voltage VCT of which a voltage value changes with time. The control voltage VCT in the present embodiment forms a triangular wave that is axial symmetry at a midpoint tc during the driving period PDR (the time point at which the driving period PDR is divided in half). That is, the control voltage VCT, as shown in FIG. 2, linearly increases from a voltage value VL to a voltage value VH that is higher than the voltage value VL as the time elapses from the starting point of the driving period PDR to the midpoint tc thereof, and linearly decreases from the voltage value VH to the voltage value VL as the time elapses from the midpoint tc to the end point.

A specific configuration of each of the unit circuits U will now be described with reference to FIG. 3. Note that, in the drawing, the i-th row and j-th column unit circuit U is shown as an example.

Figure 3:
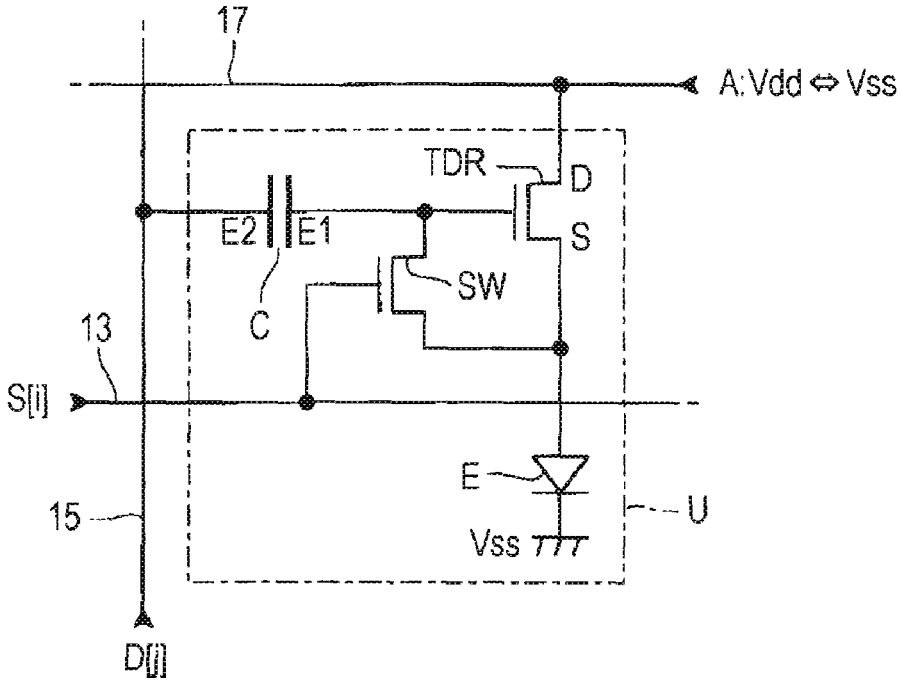
FIG. 3 is a circuit diagram that shows the configuration of one of unit circuits.

As shown in FIG. 3, the unit circuit U includes an electro-optical element E, a driving transistor TDR, a switching element SW and a capacitive element C. The electro-optical element E is a current drive light emitting element that emits light with an intensity corresponding to an electric current I1 (hereinafter, referred to as "driving current") supplied thereto. The electro-optical element E in the present embodiment is an OLED element which includes mutually opposite anode and cathode and a light emitting layer made of an organic EL (electroluminescence) material, the light emitting layer being held between the anode and the cathode. The cathode of the electro-optical element E in each of the unit circuits U is grounded (voltage value Vss).

The driving transistor TDR shown in FIG. 3 is an n-channel transistor that controls an electric current value of the driving current I1. More specifically, the driving transistor TDR is an active element that includes a gate, a source, a drain and a channel between the source and the drain. As an electrical conductive state between the source and the drain varies in accordance with a voltage Vg of the gate, the driving transistor TDR generates the driving current I1 of an electric current value corresponding to the voltage Vg. Thus, the electro-optical element E emits light with a luminance corresponding to the voltage Vg of the gate of the driving transistor TDR.

Note that, in the present embodiment, because the high and low of the voltage values of the source and drain of the driving transistor TDR are alternately inverted, the drain and source of the driving transistor TDR is, strictly speaking, exchanged occasionally. However, for the sake of convenience of description, the terminal adjacent to the electro-optical element E between the terminals of the driving transistor TDR is termed as "source (S)" and the terminal on the opposite side is termed as "drain (D)", where the high and low of voltages of the terminals of the driving transistor TDR, when the driving current I1 is supplied to the electro-optical element E through the driving transistor TDR, are defined as a reference.

The driving transistor TDR is connected between the electro-optical element E and the voltage supply line 17. That is, the drain of the driving transistor TDR is connected to the voltage supply line 17 and the source of the driving transistor TDR is connected to the anode of the electro-optical element E. The source of the driving transistor TDR is directly connected to the electro-optical element E. That is, no switching element is connected in a path in which the driving current I1 flows from the source of the driving transistor TDR to the anode of the electro-optical element E.

The switching element SW is an n-channel transistor that is connected between the gate of the driving transistor TDR and the source thereof to control electrical connection therebetween. The gate of the switching element SW is connected to the corresponding scanning line 13. Thus, when the scanning signal S[i] is changed to a high level, the switching element SW enters an on state and the driving transistor TDR is then connected to the diode. When the scanning signal S[i] is changed to a low levels the switching element SW enters an off state and the diode-connection of the driving transistor TDR is then interrupted.

The capacitive element C includes mutually opposite first electrode E1 and second electrode E2 and a dielectric that is held between the electrodes. The first electrode E1 is connected to the gate of the driving transistor TDR. The second electrode E2 is directly connected to the corresponding signal line 15 (that is, no switching element is connected between the second electrode E2 and the corresponding signal line 15). The capacitive element C is a device that holds an electric charge corresponding to a difference in potential between the first electrode E1 and the second electrode E2 (that is, a difference in potential between the signal line 15 and the gate of the driving transistor TDR).

A specific operation of the electronic device 100 will now be described with reference to FIG. 4 and FIG. 5. Hereinafter, the operation of the i-th row and j-th column unit circuit U will be described separately during one of the unit periods PU (the first period P1 and the second period P2) within the setting period PST and during the driving period PDR.

Figure 4:
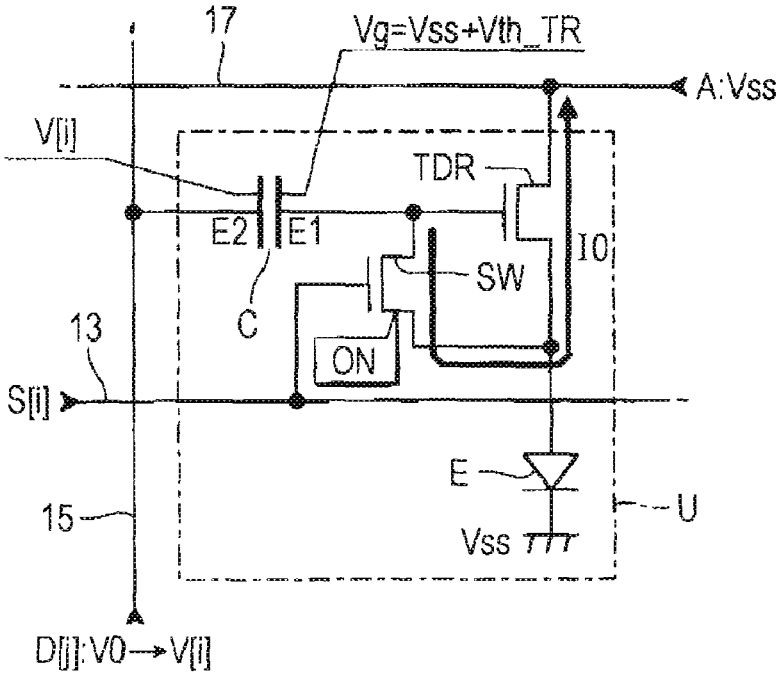
FIG. 4 is a circuit diagram that shows a state of the unit circuit during a setting period.

(a) Setting Period PST (FIG. 4)

As shown in FIG. 2, during a period from the starting point of the unit period PU to the time when the scanning signal S[i] attains a high level, the switching element SW maintains an off state, so that the first electrode E1 of the capacitive element C is in a floating state. Thus, when the data signal D[j] increases to a voltage V0 at the starting point of the first period P1, the voltage Vg of the gate of the driving transistor TDR, which is capacitively coupled through the capacitive element C to the signal line 15, increases with the variation in voltage of the data signal D[j]. As described above, as the voltage Vg of the gate increases, the driving transistor TDR enters an on state. That is, the voltage V0 of the data signal D[j] is set to a sufficiently high voltage value so that the driving transistor TDR is in an on state during the first period P1, irrespective of the voltage Vg of the gate at the starting point of the first period P1. Note that the voltage A of the voltage supply line 17 is maintained at the voltage value Vss during the setting period PST, so that even when the driving transistor TDR is changed to an on state, the driving current I1 is not supplied to the electro-optical element E.

Subsequently, when the scanning signal S[i] is changed to a high level, the switching element SW enters an on state to connect the driving transistor TDR to the diode. As the data signal D[j] increases to the voltage V0 at the starting point of the first period P1, the gate of the driving transistor TDR is applied with a potential higher than the voltage A of the voltage supply line 17 (voltage value Vss). Thus, as shown in FIG. 4, an electric current I0 that passes from the gate of the driving transistor TDR through the switching element SW, the source of the driving transistor TDR and the drain of the driving transistor TDR, in the stated order, flows to the voltage supply line 17. As the electric current I0 flows to the driving transistor TDR as described above, the voltage Vg of the gate of the driving transistor TDR converges on a value (Vss+Vth_TR) that is obtained by adding the voltage value Vss and the threshold voltage Vth_TR of the driving transistor DR.

On the other hand, the data signal D[j] is changed from the voltage V0 to the data voltage V[i] while maintaining the diode connection of the driving transistor TDR at the starting point of the second period P2. When the scanning signal S[i] is changed to a low level at the time point in the middle of the second period P2 while maintaining the above described voltage relationship, the switching element SW enters an off state and, hence, the first electrode E1 of the capacitive element C enters a floating state. Thus, as shown in FIG. 4, the differential value between the voltage (Vss+Vth_TR) of the first electrode E1 and the voltage (V[i]) of the second electrode E2 at the time point when the scanning signal S[i] is changed to a low level is maintained by the capacitive element C. That is, the data voltage V[i] is written to the capacitive element C.

During the setting period PST, as described above, the operation to store an electric charge corresponding to the data voltage V[i] and the threshold voltage Vth_TR in the capacitive element C is sequentially executed on each of the unit circuits U in the first row to n-th row for every unit circuit PU. Note that the second electrodes E2 of the unit circuits U that are arranged in the Y direction are connected to the common signal line 15, so that the voltage of the second electrode E2 of the unit circuit al, even when the unit circuit U has completed writing the data voltage V[i] to the capacitive element C during the setting period PST, occasionally varies with writing operation to another unit circuit U. However, in the unit circuit U that has completed writing the data voltage V[i], the first electrode E1 maintains a floating state by setting the switching element SW to an off state, so that the voltage of the first electrode E1 occasionally varies by variation in the voltage of the second electrode E2. Thus, the voltage of the capacitive element C is maintained at a voltage that is set during the setting period PST, irrespective of variation in voltage of the second electrode E2.

In the meantime, there is a possibility that the voltage Vg of the gate of the driving transistor TDR decreases to the voltage value Vss or below due to various disturbances (for example, noise). Under the condition that the data signal D[j] is not increased to the voltage V0 in advance of the second period P2, when the voltage Vg is accidentally decreased to the voltage value Vss or below before the commencement of the setting period PST, an electric current I0 is not generated even when the driving transistor TDR is connected to the diode. Thus, there is a problem that the voltage Vg does not converge on a voltage value corresponding to the threshold voltage Vth_TR and the electro-optical element E is not driven as desired. In the present embodiment, even when the voltage Vg of the gate is decreased to the voltage Vss or below, by increasing the data signal D[j] to the voltage V0 in advance of the second period P2, it is possible to reliably switch the driving transistor TDR to an on state during the second period P2. Thus, it is advantageous in that an influence of a disturbance, such as noise, is reduced and the operation is thus stably performed.

Figure 5:
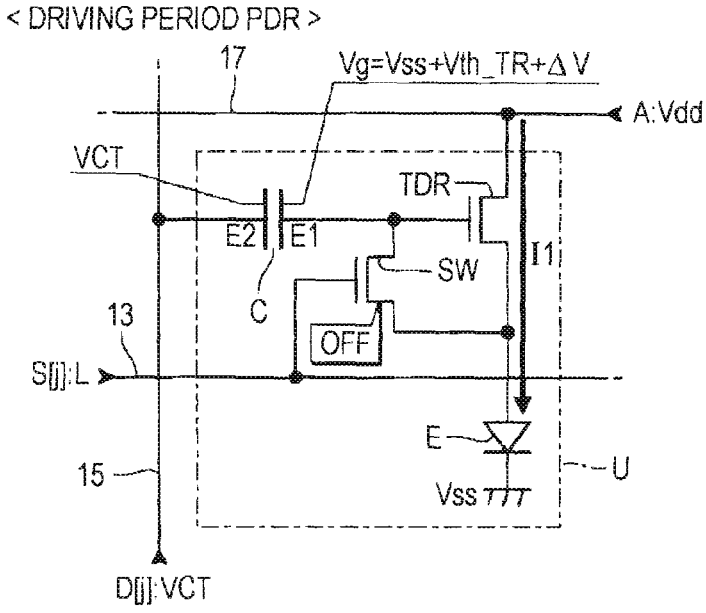
FIG. 5 is a circuit diagram that shows a state of the unit circuit during a driving period.

(b) Driving Period PDR (FIG. 5)

During the driving period PDR, the scanning signals S[1] to S[m] each maintain a low level, the switching elements SW of all unit circuits U enter an off state and the diode connection of the driving transistors TDR are interrupted. Thus, the first electrode E1 of the capacitive element C in each of the unit circuits U maintains a floating state. On the other hand, during the driving period PDR, the voltage control circuit 27 maintains the voltage A applied to the voltage supply lines 17 at the voltage value Vdd.

In the above situation, the second electrode E2 of the capacitive element C of each of the unit circuits U is supplied with the control voltage VCT that changes with time through the corresponding signal line 15. Since the first electrode E1 is in a floating state, the voltage Vg of the gate of the driving transistor TDR (that is, the voltage of the first electrode E1) changes by a voltage value ΔV corresponding to variation in voltage of the second electrode E2. The relationship between variation in voltage of the first electrode E1 and the driving current I1 will be specifically described below.

First, during the driving period PDR, when the control voltage VCT applied to the second electrode E2 becomes higher than the data voltage V[i] that has been applied during the preceding setting period PST, the voltage Vg of the gate of the driving transistor TDR increases by a voltage value ΔV corresponding to a difference between the control voltage VCT and the data voltage V[i] from the voltage value (Vss+Vth_TR) that is set during the setting period PST. Thus, the driving transistor TDR enters an on state (conductive state), so that, as shown in FIG. 5, the driving current I1 is supplied from the voltage supply line 17 through the driving transistor TDR to the electro-optical element E. Then, owing to the supply of the driving current I1 the electro-optical element E emits light.

On the other hand, when the control voltage VCT applied to the second electrode E2 during the driving period PDR becomes lower than the data voltage V[i] that has been applied during the preceding setting period PST, the voltage Vg of the gate of the driving transistor TDR is decreased by a difference between the data voltage V[i] and the control voltage VCT from the voltage value (Vss+Vth_TR) that is set during the setting period PST. Then, the driving transistor TDR enters an off state (non-conductive state), a path from the voltage supply line 17 to the electro-optical element E is blocked and the electro-optical element E is then turned off.

Thus, the driving transistor TDR of each of the unit circuits U during the driving period PDR is in an on state during a period when the control voltage VCT is higher than the data voltage V[i], and is in an off state during a period when the control voltage VCT is lower than the data voltage V[i]. That is, the electro-optical element E of each unit circuit U emits light during a period of time length corresponding to the data voltage V[i] within the driving period PDR and is turned off during the remaining period of the driving period PDR. Thus, each electro-optical element E is controlled to a gray scale level corresponding to the data voltage V[i] (gray scale control using a pulse width modulation).

As described above, in the present embodiment, during the setting period PST, the voltage Vg of the gate of the driving transistor TDR is set to a voltage value corresponding to the threshold voltage Vth_TR. In other words, the driving transistor TDR is forcibly changed to a state of boundary between conductive state and non-conductive state, irrespective of high and low of the threshold voltage Vth_TR. Thus, the time length within the driving period PDR, during which the driving transistor TDR is in an on state and the driving current I1 is supplied to the electro-optical element E, is determined on the basis of the data voltage V[i], and is not dependent on the threshold voltage Vth_TR of the driving transistor TDR. That is, according to the present embodiment, it is possible to compensate for an error of the threshold voltage Vth_TR of the driving transistor TDR (a difference from a designed value) and thus control the electro-optical element E to a desired gray scale level with high accuracy.

In addition, in the present embodiment, one unit circuit U includes two transistors as a whole. Thus, in comparison to the configuration described in JP-A-2003-122301, in which each unit circuit includes at least three transistors in order to compensate for variation in threshold voltage of the driving transistor TDR, simplification of the configuration of the electronic device 100 and a reduction in manufacturing costs are achieved, and, in addition, it is possible to increase the aperture ratio of the unit circuits U (a ratio of a region, through which light is irradiated from the electro-optical element E, to a region in which the unit circuits U are arranged).

Incidentally, the transistors (particularly, the driving transistor TDR) that form the unit circuit U may, for example, employ a thin-film transistor that uses a polycrystal silicon, a microcrystal silicon, a monocrystal silicon or an amorphous silicon as a material of a semiconductor layer, or may employ a transistor formed of a bulk silicon. It has been known that, of these transistors, particularly, in the transistor of which semiconductor layer is formed of an amorphous silicon, when the direction in which electric current flows in the transistor is permanently fixed, the threshold voltage Vth_TR changes with time.

With the configuration according to the present embodiment, during the driving period PDR, the driving current I1 flows from the drain of the driving transistor TDR to the source thereof, while, on the other hand, during the setting period PST, the current I0 flows from the source to the drain as shown in FIG. 4. That is, the direction in which electric current flows in the driving transistor TDR is inverted between during the setting period PST and during the driving period PDR. Thus, according to the present embodiment, with the configuration that employs a thin-film transistor of which a semiconductor layer is formed of an amorphous silicon as the driving transistor TDR, it is possible to suppress the threshold voltage Vth_TR from changing with time.

B: Second Embodiment

A second embodiment of the invention will now be described. The same reference numerals are assigned to the components of the following embodiments having the same or similar operation and function as those of the first embodiment, and a detailed description thereof is omitted where appropriate.

Figure 6:
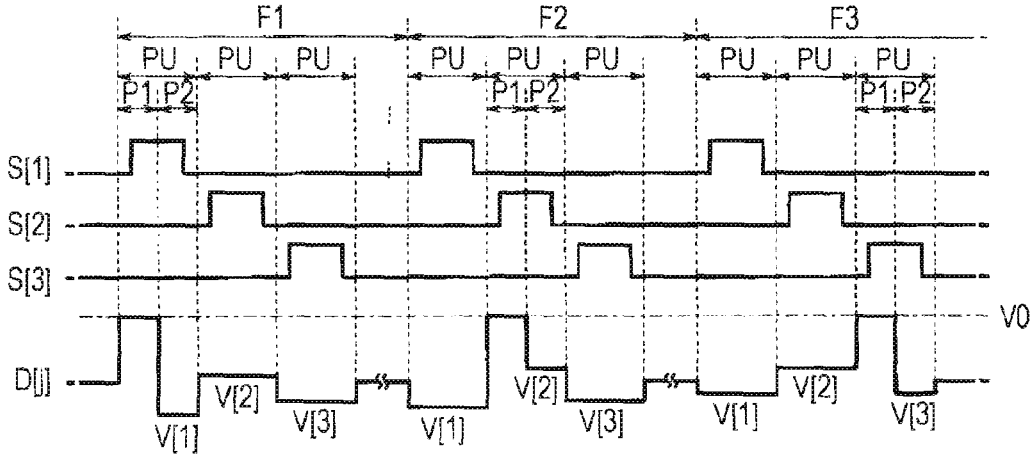
FIG. 6 is a timing chart for explaining the operation of an electronic device according to a second embodiment of the invention.

In the first embodiment, the data signal D[j] is increased to the voltage V0 in every unit period PU within one frame F. However, a period of operation that sets the data signal D[j] to the voltage V0 for conduction with the driving transistor TDR (hereinafter, referred to as "voltage setting process") is varied where appropriate. In the present embodiment, as shown in FIG. 6, a row to which the voltage setting process is performed is changed every frame F (F1, F2, F3, . . . ). That is, in the frame F1, the voltage setting process is executed only on the unit circuits U in the first row, in the frame F2, the voltage setting process is executed only on the unit circuits U in the second row, and, in the frame F3, the voltage setting process is executed only on the unit circuits U in the third row.

More specifically, as shown in FIG. 6, during the unit period PU when the scanning signal S[1] is at a high level within the frame F1, the data signal D[j] is set to the voltage V0 during the first period P1, and the data signal D[j] is set to a data voltage V[1] during the second period P2. On the other hand, during other unit circuits PU in the frame F1, the data signal D[j] is maintained at a data voltage V[i] (V[2], V[3], . . . ) over the entire period from the starting point to the end point. In addition, during the frame F2, only during the first period P1 of the unit period PU when the scanning signal S[2] is at a high level, the data signal D[j] is set to the voltage V0, and, during the other unit periods PU, the data signal D[j] maintains the data voltage V[i].

As described above, in the present embodiment, because the number of times the voltage setting process is executed is reduced in comparison with that of the first embodiment, it is advantageous in that electric power consumed in the signal line driving circuit 25 is reduced. In addition, because the number of times the voltage of the data signal D[j] is changed is reduced, it is also advantageous in that an occurrence of noise due to a change in voltage of the data signal D[j] is suppressed.

Note that the period of voltage setting process is not limited to the above example. For example, it is also applicable that the voltage setting process is executed on each of the unit circuits U in the odd-numbered rows during the odd-numbered frame, and the voltage setting process is executed on each of the unit circuits U in the even-numbered rows during the even-numbered frame. Furthermore, it is also applicable that a frame in which no voltage setting process is executed is set. For example, the voltage setting process is executed on each of the unit circuits U in one or plurality of frames, and the voltage setting process is not executed in the following predetermined number of frames.

C: Third Embodiment

Figure 7:
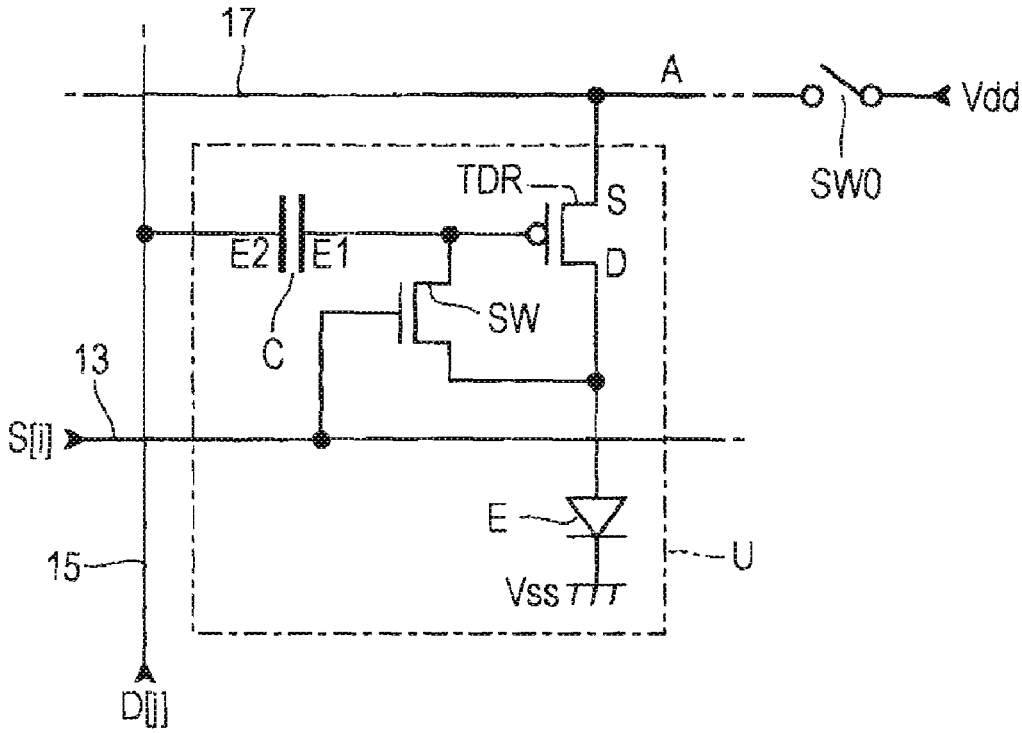
FIG. 7 is a circuit diagram that shows the configuration of one of unit circuits according to a third embodiment of the invention.

FIG. 7 is a circuit diagram that shows the configuration of one of unit circuits according to a third embodiment. As shown in the drawing, in the present embodiment, a p-channel transistor is used as the driving transistor TDR. The source of the driving transistor TDR is connected to the voltage supply line 17, and the drain of the driving transistor TDR is connected to the anode of the electro-optical element E. In addition, the voltage supply line 17 is connected through a switch, SW0 to the voltage control circuit 27. The voltage control circuit 27 outputs the voltage Vdd to the switch SW0 in each row.

Figure 8:
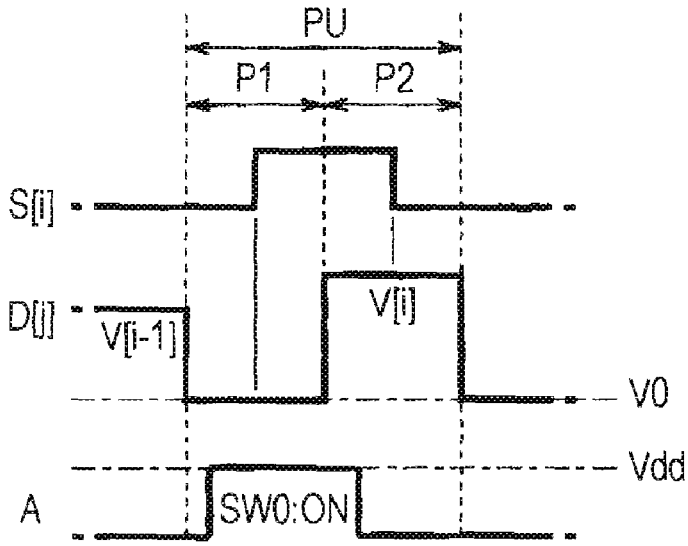
FIG. 8 is a timing chart for explaining the operation of an electronic device.

FIG. 8 is a timing chart that shows the waveforms of the scanning signal S[i], the data signal D[j] and the voltage A during a unit period PU when the i-th row is selected. As shown in the drawing, during the first period P1 in the unit period PU, the data signal D[j] of the signal line 15 is decreased to the voltage V0, while the first electrode E1 of the capacitive element C is maintained in a floating state (that is, when the scanning signal S[i] is at a low level). The voltage Vg of the gate that is capacitively coupled to the signal line 15 decreases with a change in the data signal D[j], so that the driving transistor TDR enters an on state. That is, the voltage V0 is set to a sufficiently low voltage value so that the driving transistor TDR enters an on state during the first period P1, irrespective of the voltage Vg of the gate at the starting point of the first period P1. In terms that the data signal D[j] is set to the data voltage V[i] during the second period P2, it is the same as that of the first embodiment.

On the other hand, as shown in FIG. 8 in a period from the time when the data signal D[j] is decreased to the voltage V0 within the i-th unit period PU to the time when the scanning signal S[i] is changed to a low level, the i-th switch SW0 is set to an on state. Thus, the voltages A supplied to the i-th row unit circuits U are set to the voltage value Vdd. Since the driving transistor TDR enters an on state owing to a decrease in voltage of the data signal D[j], electric current flows from the voltage supply line 17 through the driving transistor TDR to the electro-optical element E. In addition, in a period when the voltage A is set to the voltage value Vdd, the scanning signal S[i] is changed to a high level and, hence, the driving transistor TDR is connected to the diode. Then, when the switch SW0 is changed to an off state and the supply of voltage A of the voltage value Vdd is stopped, the voltage of the drain (and, in addition, the voltage Vg of the gate) of the driving transistor TDR decreases with time and then converges on the threshold voltage Vth_EL of the electro-optical element E. Thus, when the scanning signal S[i] is changed to a low level and thereby the first electrode E1 enters a floating state, the differential value between the voltage Vg (Vth_EL) of the gate (first electrode E1) of the driving transistor TDR and the voltage V[i] of the second electrode E2 is maintained in the capacitive element C, and the voltage of the anode of the electro-optical element E is set to the voltage Vth_EL.

During the driving period PDR, the switch SW0 in every row is set to an on state. Thus, the voltage A supplied to each of the unit circuits U is set to the voltage Vdd. In addition, by setting the data signal D[j] to the control voltage VCT, as in the case of the first embodiment, the conductive state of the driving transistor TDR changes in accordance with the data voltage V[i] in the preceding unit period PU. Because the voltage of the anode of the electro-optical element E changes in accordance with the above described operation of the driving transistor TDR, the electro-optical element E is controlled to a gray scale level corresponding to the data voltage V[i]. At the starting point of the driving period PDR, the voltage of the anode of the electro-optical element E is set to its own threshold voltage Vth_EL. That is, because the voltage of the anode of the electro-optical element E changes using the threshold voltage Vth_EL as an initial point during the driving period PDR, in the present embodiment, it is possible to compensate for variation in threshold voltage Vth_EL of the electro-optical element E.

As described above, in the present embodiment, by decreasing the data signal D[j] to the voltage V0 in advance of the second period P2, the driving transistor TDR is reliably changed to an on state irrespective of high and low of the voltage Vg of the gate at the starting point of the first period P1. Thus, it is possible to reliably hold a desired voltage corresponding to the data voltage V[i] in the capacitive element C. Accordingly, as in the case of the first embodiment, it is advantageous in that an influence of a disturbance, such as noise, is reduced and the operation is thus stably performed.

D: Alternative Examples

The above described embodiments may be modified into various forms. Specific alternative examples may be exemplified below. Note that the following examples may be combined with each other where appropriate.

(1) First Alternative Example

The waveform of the data signals D[1] to D[n] during the driving period PDR (the waveform of the control voltage VCT) may be changed where appropriate. For example, a triangular wave is exemplified in the above described embodiments; however, the waveform of the control voltage VCT need not be symmetric. For example, various types of waveform, such as a ramp wave, a saw tooth wave (saw wave) and a multi ramp wave (stepped wave), may be employed as the control voltage VCT. In addition, not only a waveform in which a voltage value linearly varies but also a waveform in which a voltage value curvedly varies like a sine wave may be employed as the control voltage VCT.

In addition, in the above described embodiments, the configuration in which the control voltage VCT during the driving period PDR corresponds to one period of a triangular waveform is described. However, the control voltage VCT may employ a waveform that includes a plurality of units of various types of waveform, such as a triangular wave, the above exemplified ramp wave and saw tooth wave, which are continuously formed during the driving period PDR (that is, a waveform in which an increase in voltage and a decrease in voltage are alternated more than once). That is, in the embodiments of the invention, various tapes of waveform in which a voltage varies with time during the driving period PDR may be employed as the control voltage VCT.

(2) Second Alternative Example

The OLED element is only an example of the electro-optical element. Regarding the electro-optical element applied to the aspects of the invention, it need not to distinguish a self luminous-type electro-optical element that emits light by itself from a nonluminous-type electro-optical element (for example, liquid crystal element) that changes its transmittance ratio of outside light and also need not to distinguish a current drive-type electro-optical element that is driven by the supply of electric current from a voltage drive-type electro-optical element that is driven by the application of voltage (driving voltage). For example, various electro-optical element, such as an inorganic EL element, a field emission (FE) element, a surface-conduction electron-emitter (SE) element, a ballistic electron surface emitting (BS) element, a LED (light emitting diode) element, a liquid crystal element, an electrophoretic element and an electrochromic element, may be used. In addition, the aspects of the invention may be applied to a sensing device or a bio-chip, or the like. The driven elements of the aspects of the invention include all elements that are driven by the application of electric energy. The electro-optical element, such as a light emitting element, is an example of the driven element.

E: Application Examples

Figure 9:
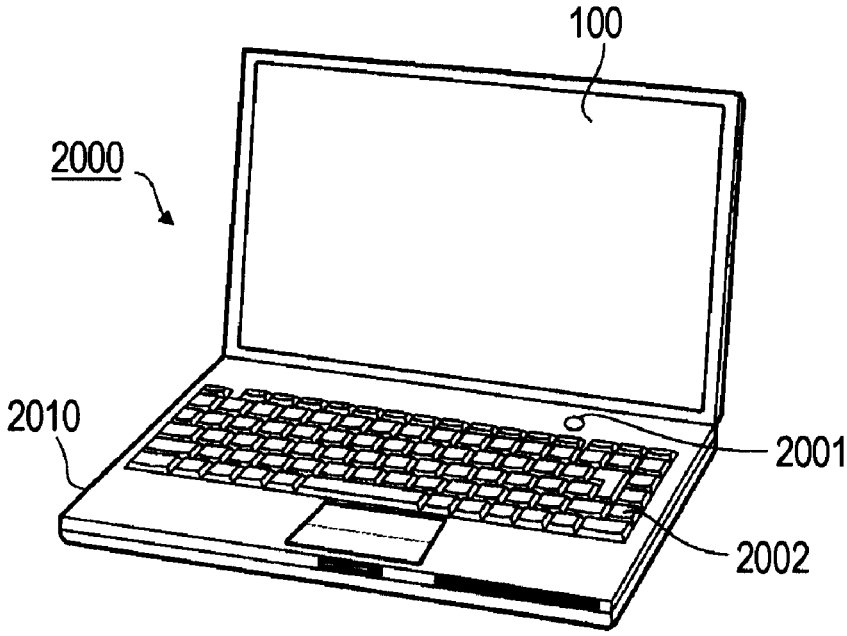
FIG. 9 is a perspective view that shows one embodiment (personal computer) of an electronic apparatus.

Electronic apparatuses that employ the electronic device 100 will now be described. FIG. 9 is a perspective view that shows the configuration of a mobile personal computer that employs the electronic device 100 according to any one of the embodiments described above as a display device. The personal computer 2000 includes the electronic device 100, which serves as a display device, and a main body portion 2010. The main body portion 2010 is provided with a power switch 2001 and a keyboard 2002. This electronic device 100 uses an OLED element for the electro-optical element E, so that it is possible to display a screen that has a wide viewing angle and that is easily viewable.

Figure 10:
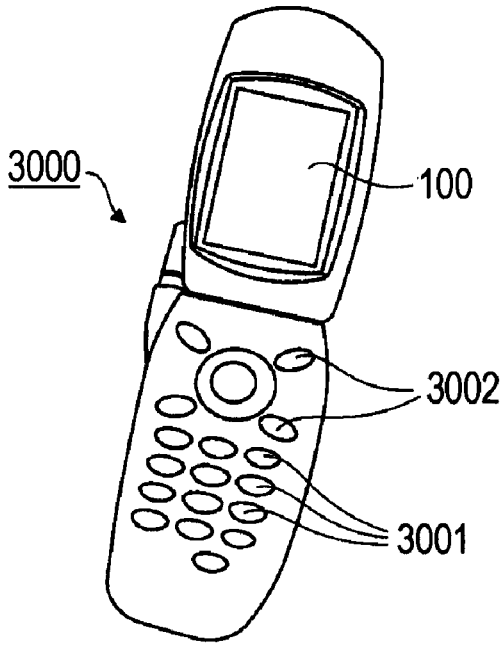
FIG. 10 is a perspective view of another embodiment (mobile telephone) of an electronic apparatus.

FIG. 10 shows the configuration of a mobile telephone that employs the electronic device 10, according to the above described embodiments. The mobile telephone 3000 includes a plurality of operation buttons 3001, a plurality of scroll buttons 3002, and the electronic device 100, which serves as a display device. By manipulating the scroll buttons 3002, an image displayed on the electronic device 100 is scrolled.

Figure 11:
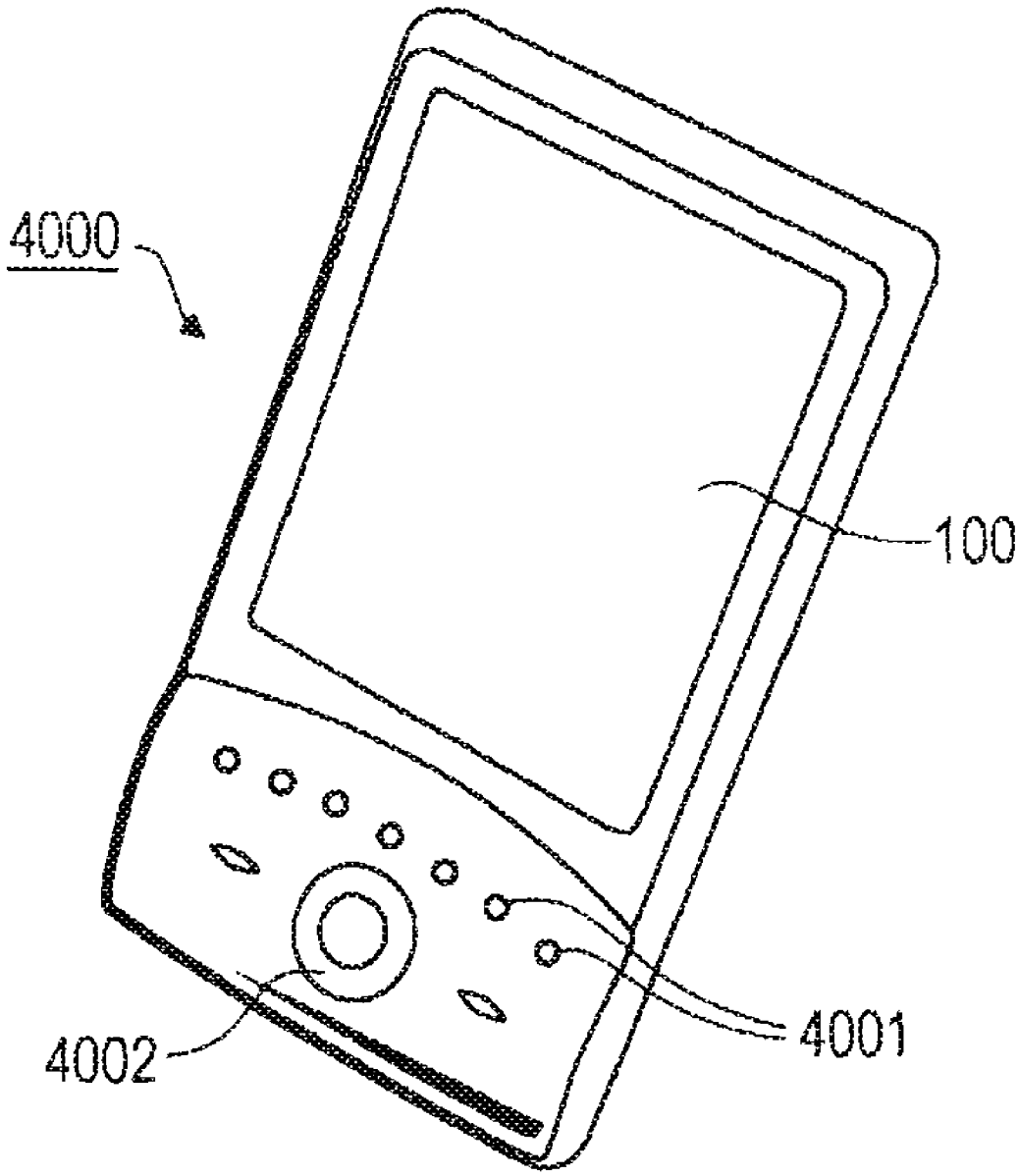
FIG. 11 is a perspective view that shows yet another embodiment (portable information terminal, of an electronic apparatus.

FIG. 11 shows the configuration of a portable information terminal (PDA: personal digital assistant) that employs the electronic device 100 according to the above described embodiments. The portable information terminal 4000 includes a plurality of operation buttons 4001, a power switch 4002, and the electronic device 100, which serves as a display device. As the power switch 4002 is manipulated, various pieces of information, such as an address book and a schedule book, are displayed on the electronic device 100.

Note that the electronic apparatuses that employ the electronic device (electro-optical device) according to the aspects of the invention include, in addition to the apparatuses shown in FIG. 9 to FIG. 11, a digital still camera, a television, a video camera, a car navigation system, a pager, an electronic personal organizer, an electronic paper, an electronic calculator, a word processor, a workstation, a video telephone, a POS terminal, a printer, a scanner, a photocopier, a video player, and devices provided with a touch panel display. However, applications of the electronic device are not limited to image display. For example, in an image forming apparatus, such as an optical writing type printer or an electronic copying machine, a writing head is used to expose a photoreceptor in accordance with an image to be formed on a recording material such as a paper. The electronic device according to the aspects of the invention may be used as a writing head of this type. The unit circuit described in the aspects of the invention not only includes a circuit (so-called pixel circuit) that forms a pixel of a display device but also includes a circuit that forms a unit of exposure in an image forming apparatus.

What is claimed is:

1. An electronic circuit that drives a driven element to which a driving voltage or a driving current is supplied, comprising:

a signal line;

a unit circuit connected to the signal line; and a voltage supply line, the unit circuit comprising:

a driving transistor comprising a gate terminal, a first terminal, a second terminal connected to the voltage supply line, and a channel formed between the first terminal and the second terminal;

a switching element that controls an electrical connection between the gate terminal of the driving transistor and one of the first terminal and the second terminal; and a capacitive element that includes a first electrode connected to the gate terminal of the driving transistor and a second electrode connected to the signal line, wherein a conductive state between the first terminal and the second terminal is controlled by a gate voltage applied to the gate terminal, a first signal is supplied to the signal line during a first period, and the switching element is changed from an off state to an on state, a second signal is supplied to the signal line during a second period after the first period, and the switching element in the on state is changed to an off state, from a period in which the first signal is supplied to the signal line through a period in which the second signal is supplied to the signal line, there is only one time that the switching element is placed into an on state, the first signal is a fixed voltage V0 and the second signal is a data voltage V[i], and the fixed voltage V0 is supplied prior to supply of each data voltage V[i] during the second period, and the fixed voltage V0 is greater than said each data voltage V[i].

2. The electronic circuit according to claim 1, the switching element being changed into the on state after a voltage level of the gate voltage is set to a second voltage level, whereby the gate voltage is changed to a third voltage level.

3. The electronic circuit according to claim 1, wherein a conductive state between the first terminal and the second terminal, when the gate voltage is set to the second voltage level, is higher than a conductive state between the first terminal and the second terminal, when the gate voltage is set to the first voltage level.

4. The electronic circuit according to claim 1, wherein a difference between a voltage level of the second electrode and a third voltage level that is a voltage level of the gate voltage during the second period corresponds to an integral quantity of a driving current supplied to the driven element during a predetermined period.

5. The electronic circuit according to claim 1, a difference between a voltage level of the second electrode and a voltage level of the gate during the second period corresponds to a time length of a period in which a driving current or a driving voltage is supplied to the driven element.

6. An electronic device comprising:

a signal line;

a plurality of unit circuits connected to the signal line; and a voltage supply line, wherein one of the plurality of unit circuits comprises:

a driving transistor that includes a gate terminal, a first terminal, a second terminal connected to the voltage supply line, and a channel formed between the first terminal and the second terminal;

a driven element connected to the driving transistor;

a switching element that controls an electrical connection between the gate terminal of the driving transistor and one of the first terminal and the second terminal; and a capacitive element that includes a first electrode connected to the gate terminal of the driving transistor and a second electrode connected to the signal line, wherein a conductive state between the first terminal and the second terminal is controlled by a gate voltage applied to the gate terminal, a first signal is supplied to the signal line during a first period, and the switching element is changed from an off state to an on state, a second signal is supplied to the signal line during a second period after the first period, and the switching element in the on state is changed to the off state, from a period in which the first signal is supplied to the signal line through a period in which the second signal is supplied to the signal line, there is only one time that the switching element is placed into an on state, the first signal is a fixed voltage V0 and the second signal is a data voltage V[i], and the fixed voltage V0 is supplied prior to supply of each data voltage V[i] during the second period, and the fixed voltage V0 is greater than said each data voltage V[i].

7. The electronic device according to claim 6, further comprising:

a voltage control circuit that sets a potential of the voltage supply line to a plurality of potentials.

8. The electronic device according to claim 6, further comprising:

a voltage control circuit that controls an electrical connection between the voltage supply line and a predetermined potential.

9. The electronic device according to claim 6, wherein the second electrode is directly connected to the signal line.

10. The electronic device according to claim 6, wherein during a driving period that comes after a setting period that includes the first period and the second period has elapsed, the switching element is changed into an off state to set the first electrode to a floating state, while a control voltage that changes with time is supplied to the second electrode.

11. The electronic device according to claim 10, wherein during at least part of the setting period, a voltage of the voltage supply line is set to a first voltage value that is lower than a voltage of the first terminal, and during at least part of the driving period, the voltage of the voltage supply line is set to a second voltage value that is higher than the voltage of the first terminal.

12. The electronic device according to claim 11, wherein the switching element is a switching transistor, and transistors included in each of the plurality of unit circuits are the driving transistor and the switching transistor only.

13. An electronic apparatus comprising the electronic device according to claim 6.

14. An electro-optical device comprising:

a signal line;

a plurality of unit circuits connected to the signal line; and a voltage supply line, wherein one of the plurality of unit circuits comprises:

a driving transistor that includes a gate terminal, a first terminal, a second terminal connected to the voltage supply line, and a channel formed between the first terminal and the second terminal;

an electro-optical element in communication with the voltage supply line and the driving transistor;

a switching element that controls an electrical connection between the gate terminal of the driving transistor and one of the first terminal and the second terminal; and a capacitive element that includes a first electrode connected to the gate terminal of the driving transistor and a second electrode connected to the signal line, wherein a conductive state between the first terminal and the second terminal is controlled by a gate voltage applied to the gate terminal, a first signal is supplied to the signal line during a first period, and the switching element is changed from an off state to an on state, a second signal is supplied to the signal line during a second period after the first period, and the switching element in the on state is changed to the off state, from a period in which the first signal is supplied to the signal line through a period in which the second signal is supplied to the signal line, there is only one time that the switching element is placed into an on state, the first signal is a fixed voltage V0 and the second signal is a data voltage V[i], and the fixed voltage V0 is supplied prior to supply of each data voltage V[i] during the second period, and the fixed voltage V0 is greater than said each data voltage V[i].

15. A method of driving an electronic device that includes a unit circuit connected to a signal line, the unit circuit including a driving transistor, a driven element, a switching element, and a capacitive element, the driving transistor including a gate terminal, a first terminal, a second terminal connected to a voltage supply line, and a channel formed between the first terminal and the second terminal, the switching element controlling an electrical connection between the gate terminal of the driving transistor and one of the first terminal and the second terminal, the capacitive element including a first electrode connected to the gate terminal of the driving transistor and a second electrode connected to the signal line, a conductive state between the first terminal and the second terminal being controlled by a gate voltage applied to the gate terminal, the method comprising:

supplying a first signal to the signal line during a first period, and changing the switching element from an off state to an on state, and supplying a second signal to the signal line during a second period after the first period, and changing the switching element in the on state to an off state, wherein from a period in which the first signal is supplied to the signal line through a period in which the second signal is supplied to the signal line, there is only one time that the switching element is placed into an on state, the first signal is a fixed voltage V0 and the second signal is a data voltage V[i], and the fixed voltage V0 is supplied prior to supply of each data voltage V[i] during the second period, and the fixed voltage V0 is greater than said each data voltage V[i].

* * * * *